US008075237B2

(12) United States Patent
Webster et al.

(10) Patent No.: US 8,075,237 B2
(45) Date of Patent: Dec. 13, 2011

(54) MULTI-LEVEL VEHICLE LIFT

(75) Inventors: Mark R. Webster, Hubertus, WI (US); Gene M. Barth, Thiensville, WI (US)

(73) Assignee: Pflow Industries, Inc., Milwaukee, WI (US)

( * ) Notice: Subject to any disclaimer, the term of this patent is extended or adjusted under 35 U.S.C. 154(b) by 407 days.

(21) Appl. No.: 12/269,799

(22) Filed: Nov. 12, 2008

(65) Prior Publication Data

US 2010/0119338 A1 May 13, 2010

(51) Int. Cl.
*B65G 67/00* (2006.01)

(52) U.S. Cl. ..... 414/239; 414/233; 414/331.14; 414/611; 187/205; 187/207; 187/211

(58) Field of Classification Search ..... 414/239, 414/331.14, 592, 611, 233; 187/210, 205, 187/207

See application file for complete search history.

(56) References Cited

U.S. PATENT DOCUMENTS

| | | | | | |
|---|---|---|---|---|---|
| 3,625,379 | A | * | 12/1971 | Gregory et al. | 414/590 |
| 3,712,485 | A | * | 1/1973 | Klaus | 414/229 |
| 3,960,282 | A | | 6/1976 | Manaugh | |
| 4,015,733 | A | * | 4/1977 | Woehr et al. | 414/249 |
| 4,413,942 | A | | 11/1983 | Roth et al. | |
| 4,674,938 | A | | 6/1987 | Van Stokes et al. | |
| 4,826,384 | A | * | 5/1989 | Okura et al. | 414/234 |
| 5,035,562 | A | | 7/1991 | Rosen | |
| 5,129,776 | A | * | 7/1992 | Peng | 414/228 |
| 5,335,755 | A | | 8/1994 | Miller | |
| 5,622,466 | A | | 4/1997 | Rossato | |
| 6,065,921 | A | | 5/2000 | Van Dijk | |
| 6,241,049 | B1 | | 6/2001 | Gooch | |
| 6,336,781 | B1 | | 1/2002 | Doppelmayr et al. | |
| 6,571,970 | B1 | | 6/2003 | Spoeler et al. | |
| 7,770,695 | B2 | * | 8/2010 | Myers | 187/215 |
| 2010/0014950 | A1 | * | 1/2010 | Blackmore | 414/229 |

* cited by examiner

*Primary Examiner* — Scott Lowe
(74) *Attorney, Agent, or Firm* — Michael Best & Friedrich LLP

(57) ABSTRACT

A multi-level vehicle lift comprising a first platform mounted for movement between a lowered position and a raised position. A second platform is positioned below the first platform and is coupled to the first platform by a lift member such that movement of the first platform above a first raised position causes movement of the second platform. A third platform is positioned below the second platform and coupled to the first platform by a lift member such that movement of the first platform above a second raised position causes movement of the third platform A pit may be positioned below the platforms, and the lower-most platform is in the pit when the first platform is in the lowered position. Preferably, the pit is recessed into a ground surface, and an upper surface of the first platform is substantially flush with the ground surface when in the lowered position.

20 Claims, 11 Drawing Sheets

MULTI-LEVEL VEHICLE LIFT

FIELD OF THE INVENTION

The present invention generally relates to the field of vehicle lifts and, more specifically, to vehicle lifts capable of lifting multiple vehicles in a vertically-spaced orientation.

BACKGROUND OF THE INVENTION

In certain parking structures, such as those located in densely-populated urban areas, it is known to provide mechanisms that are capable of storing vehicles in closely-spaced configurations. For example, U.S. Pat. No. 4,674,938 discloses a vehicle parking system that facilitates the parking and storage of vehicles on vertically-spaced platforms.

SUMMARY OF THE INVENTION

The present invention provides a multi-level vehicle lift comprising at least three platforms. A first platform is mounted for movement between a lowered position and a raised position. A second platform is positioned below the first platform and is coupled to the first platform by a short collapsible lift member (e.g., a short lift rod) such that upward movement of the first platform above a first raised position causes upward movement of the second platform. A third platform is positioned below the second platform and coupled to the first platform by a long collapsible lift member (e.g., a long lift rod secured at one end to the third platform and secured at an opposing end to the first platform) such that upward movement of the first platform above a second raised position causes upward movement of the third platform. In one embodiment, the vehicle lift further comprises a fourth platform below the third platform and coupled to the first platform by a longer collapsible lift member (e.g., a longer lift rod) such that upward movement of the first platform above a third raised position causes upward movement of the fourth platform.

In another aspect of the invention, a pit is positioned below the platforms, and at least the lower-most platform is at least partially in the pit when the first platform is in the lowered position. Preferably, the pit is recessed into a ground surface, and an upper surface of the first platform is substantially flush with the ground surface when in the lowered position. Similarly, it is preferred that an upper surface of the second platform is substantially flush with the ground surface when the first platform is in the raised position.

DETAILED DESCRIPTION

FIGS. 1-11 illustrate a vehicle lift 20 embodying the present invention. The vehicle lift 20 includes four vertical columns 22 that are stabilized by a series of horizontal beams 24. The columns are adapted to guide four platforms 26, 28, 30, 32 for vertical movement.

Figure 1:
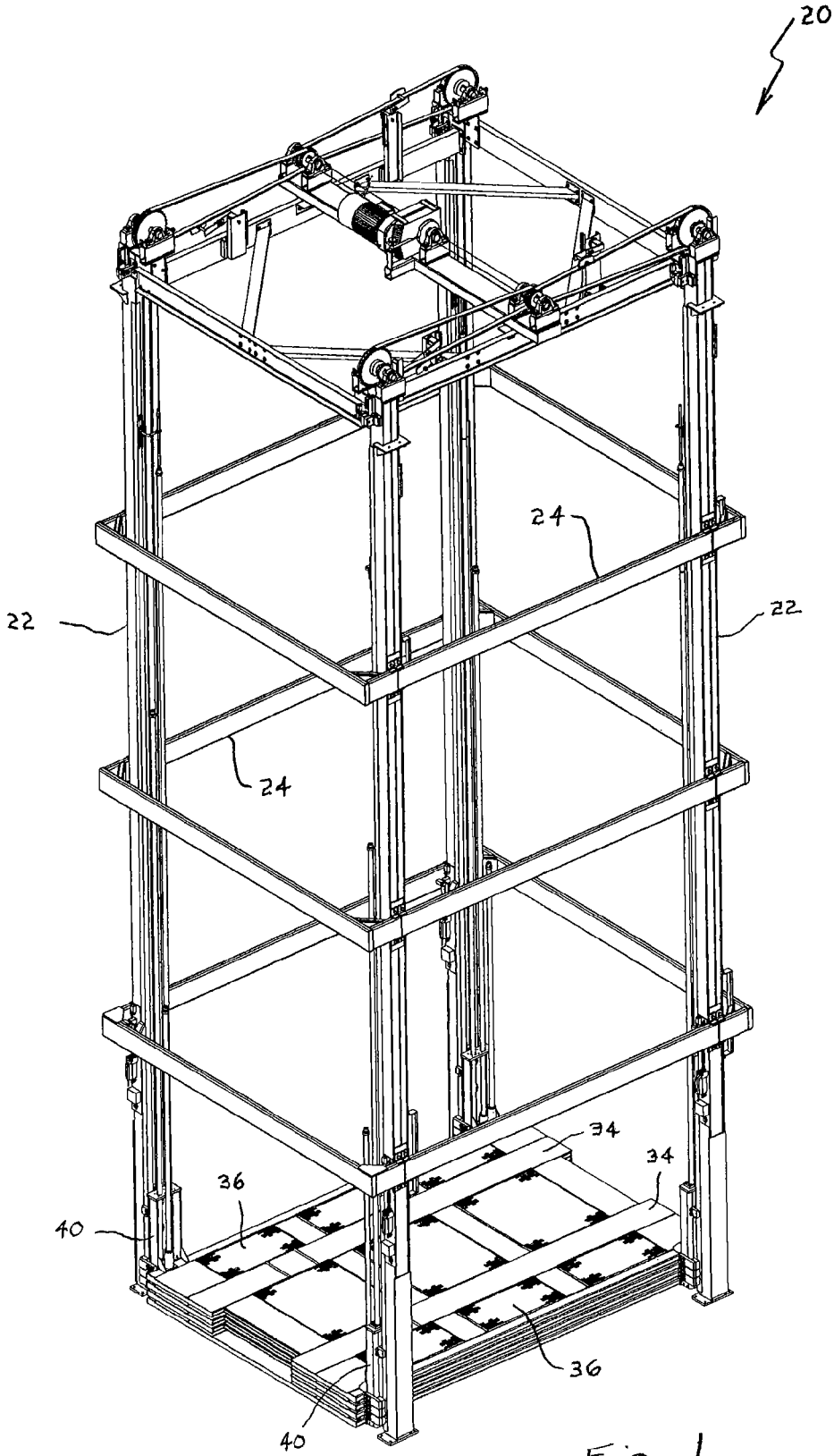
FIG. 1 is a perspective view of a multi-level vehicle lift embodying the present invention and in a lowered position.
Figure 2:
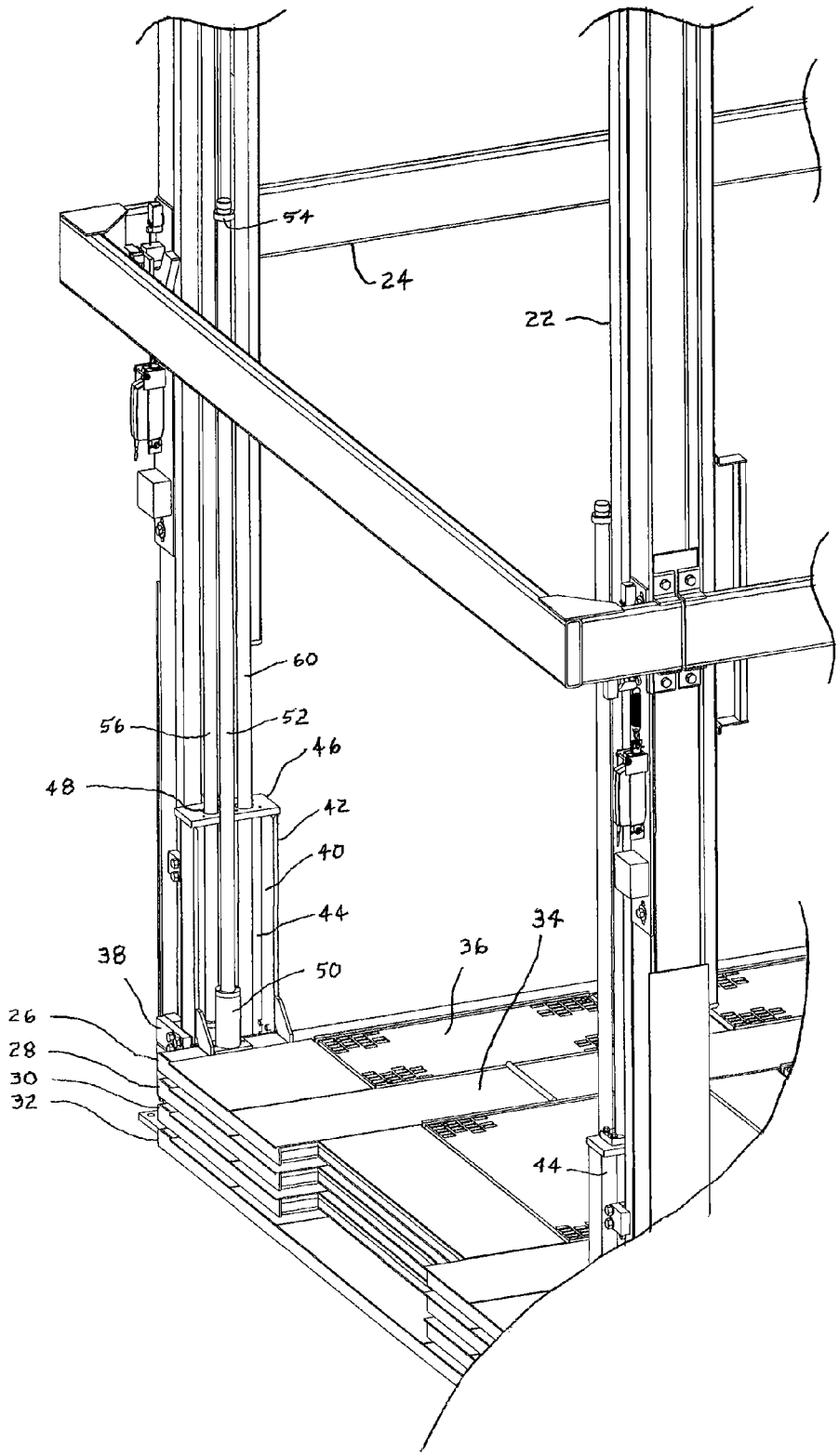
FIG. 2 is an enlarged view of a lower portion of the vehicle lift illustrated in FIG. 1.

Referring to FIGS. 1 and 2, each of the illustrated platforms includes wheel-support panels 34 for supporting the wheels of a vehicle positioned on the platform. Each platform further includes perforated panels 36 that provide structural integrity and reduced weight to the platform. The perforated panels further facilitate the transmission of light through the platforms 26, 28, 30, 32.

Figure 11:
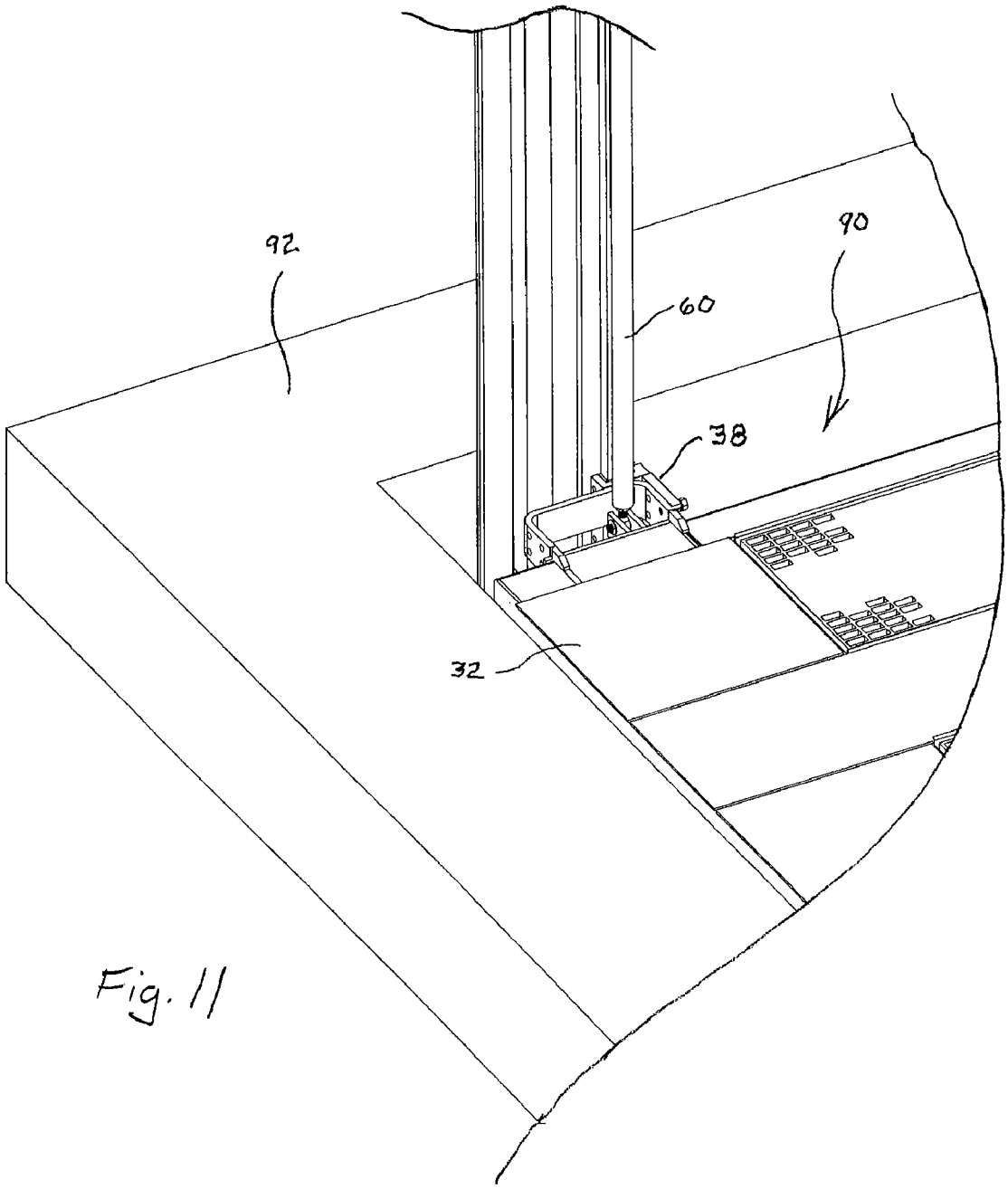
FIG. 11 is an enlarged perspective view of a lower portion of the vehicle lift of FIG. 9.

Pairs of guide members 38 (FIGS. 2, 6, 8, 10, and 11—one of the guide members in FIG. 11 is removed for clarity) are secured at each corner of each platform 26, 28, 30, 32 adjacent a corresponding column. Each pair of guide members straddles the outer opposing surfaces of the corresponding column and facilitates guided vertical movement of the platform relative to the columns.

Each corner of the first platform 26 further includes a lift housing 40 that facilitates lifting the first platform 26. Each lift housing 40 includes side plates 42, a back plate 44, and a lift plate 46 secured to the top end of the side plates 42 and back plate 44. The lift plate 46 includes two openings 48, the functions of which are described below. Each corner of the first platform 26 further includes a lift tube 50 secured to and extending upwardly from the upper surface of the first platform 26.

Each corner of the second platform 28 includes a short lift rod 52 (FIG. 2) pivotally attached to and extending upwardly from a top surface of the second platform 28. Each short lift rod 52 is positioned to slide through the corresponding lift tube 50 on the first platform 26. Each short lift rod 52 further includes a cap 54 on the upper end to limit relative movement between the lift tube 50 and the short lift rod 52.

Each corner of the third platform 30 includes a medium lift rod 56 (FIGS. 2, 5, and 8) pivotally attached to and extending upwardly from the third platform 30. Each medium lift rod 56 is positioned to slide through one of the openings 48 in the corresponding lift housing 40 attached to the first platform 26. Each medium lift rod 56 further includes a cap 58 on an upper end to limit relative movement between the lift housing 40 and the medium lift tube 50.

Figure 3:
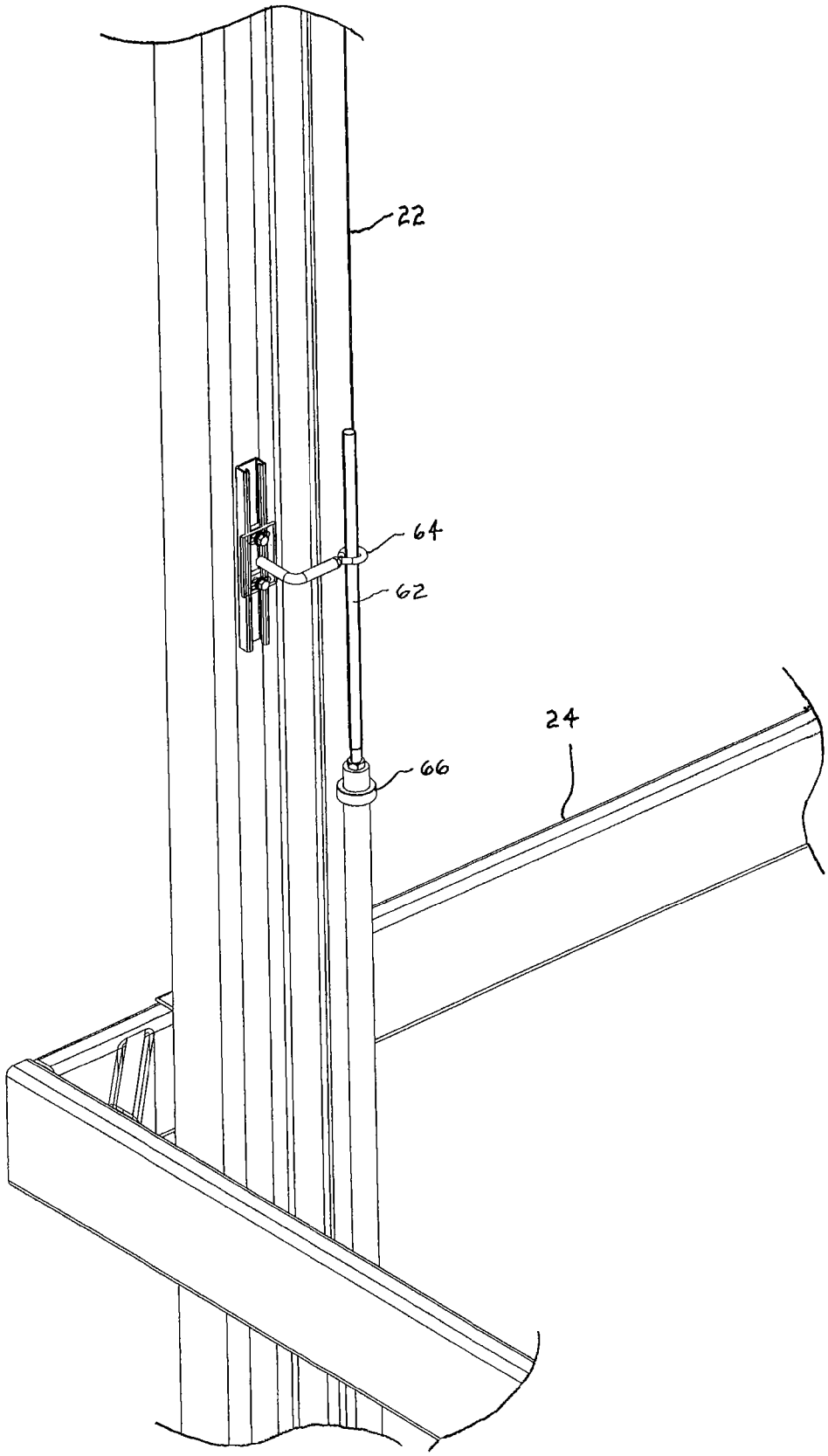
FIG. 3 is an enlarged view of a side portion of the vehicle lift of FIG. 1.

Each corner of the fourth platform 32 includes a long lift rod 60 (FIGS. 2 and 3) pivotally attached to and extending upwardly from the fourth platform 32. Each long lift rod 60 is positioned to slide through the other opening of the corresponding lift housing 40 attached to the first platform 26. Referring to FIG. 3, the upper end of the long lift rod 60 includes an extended portion 62 that is supported by and positioned to slide through an alignment member 64 attached to the corresponding column. Each long lift rod 60 further includes a cap 66 on an upper end to limit relative movement between the lift housing 40 and the long lift rod 60.

Figure 4:
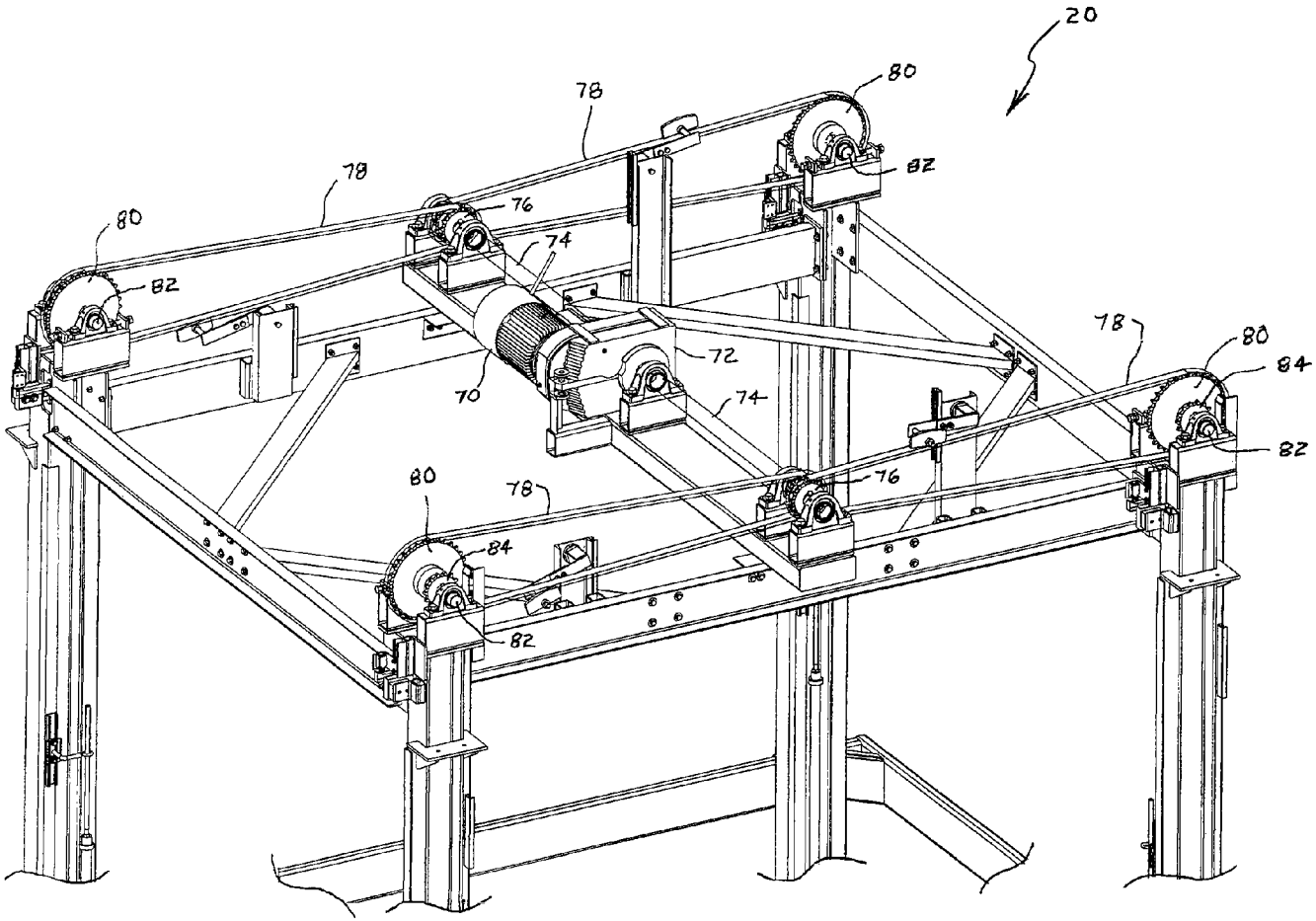
FIG. 4 is an enlarged perspective view of an upper portion of a vehicle lift of FIG. 1.
Figure 5:
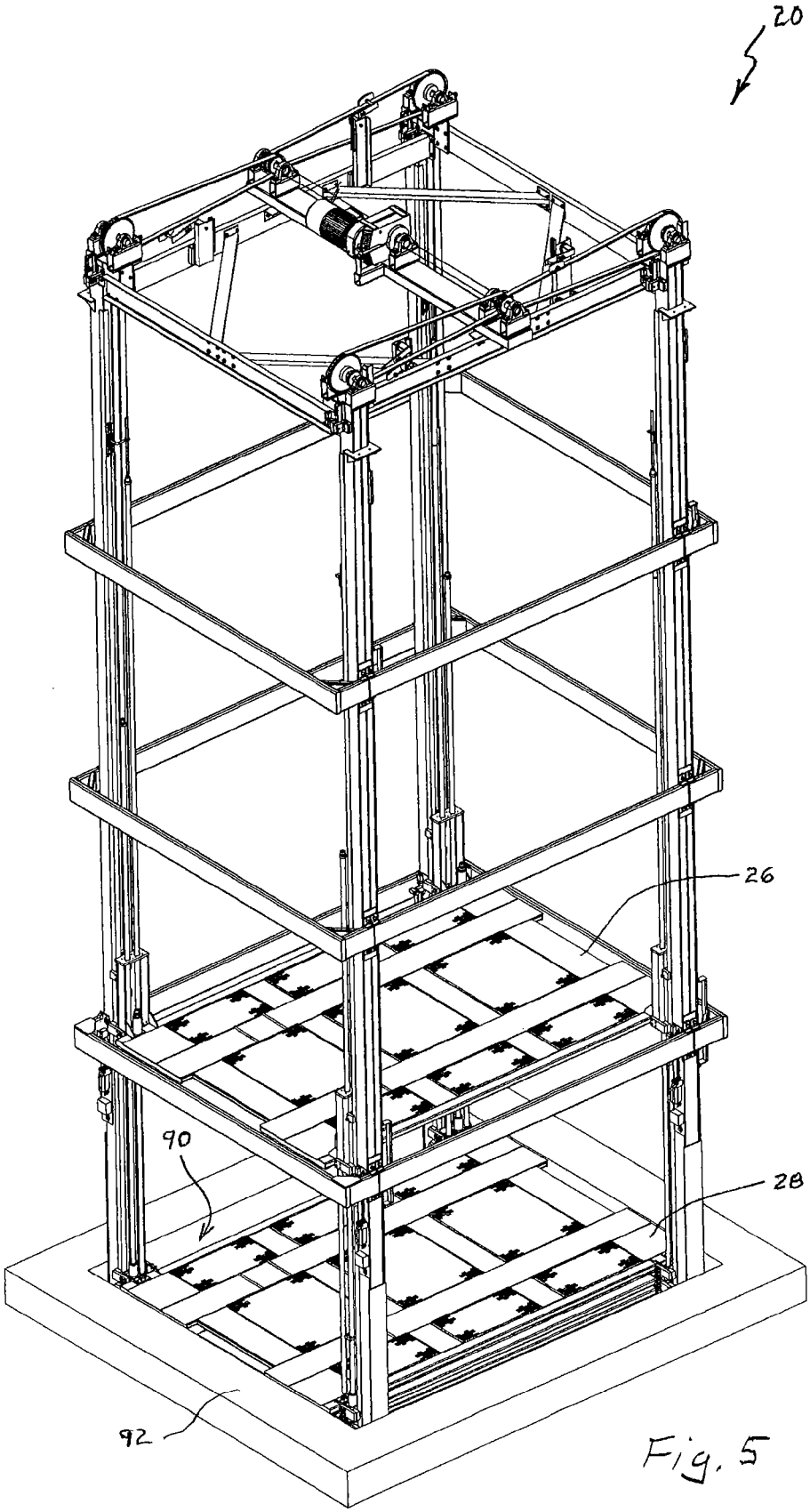
FIG. 5 is a perspective view of the vehicle lift of FIG. 1 in a first raised position.

Referring to FIG. 4, the vertical lift 20 further includes a lift mechanism including a drive motor 70 adapted to provide power to a transmission 72. The transmission 72 rotates two drive shafts 74, and each drive shaft is secured to two primary sprockets 76 that each drives a primary chain 78, resulting in power being provided to the upper portion of each vertical column. Each primary chain 78 drives an intermediate sprocket 80 that drives an intermediate shaft 82 and secondary sprocket 84. The secondary sprocket 84 drives a secondary chain (removed for clarity) that is positioned vertically within each column and is supported on its lower end by a lower sprocket (not shown).

A portion of each secondary chain is secured to a corresponding lift housing 40 such that movement of the secondary chain results in vertical movement of the corresponding lift housing 40. Because of the synchronous nature of the lift mechanism described above, each of the four lift housings 40 will be moved vertically in a synchronized manner to thereby provide vertical movement to the first platform 26 in a substantially level orientation. It should be understood that the illustrated lift mechanism is one example, but other lift mechanisms could be used, such as hydraulic, screw, rack and pinion, etc.

Utilizing the structure described above and illustrated in the drawings, the vehicle tower can be operated in the following manner to result in four vehicles being positioned on four vertically-spaced platforms. Referring to FIG. 1., a vehicle can be driven onto the first platform 26 with the vehicle lift 20 in the lowered position. Although not shown in FIG. 1 (for clarity), the vehicle lift 20 is designed to be mounted in a pit 90 that is recessed into the ground surface 92 (see FIGS. 5, 7, 9, and 11). In the lowered position of the vehicle lift 20, all of the platforms are in the pit 90, and the upper surface of the first platform 26 is aligned with the ground surface 92.

Figure 6:
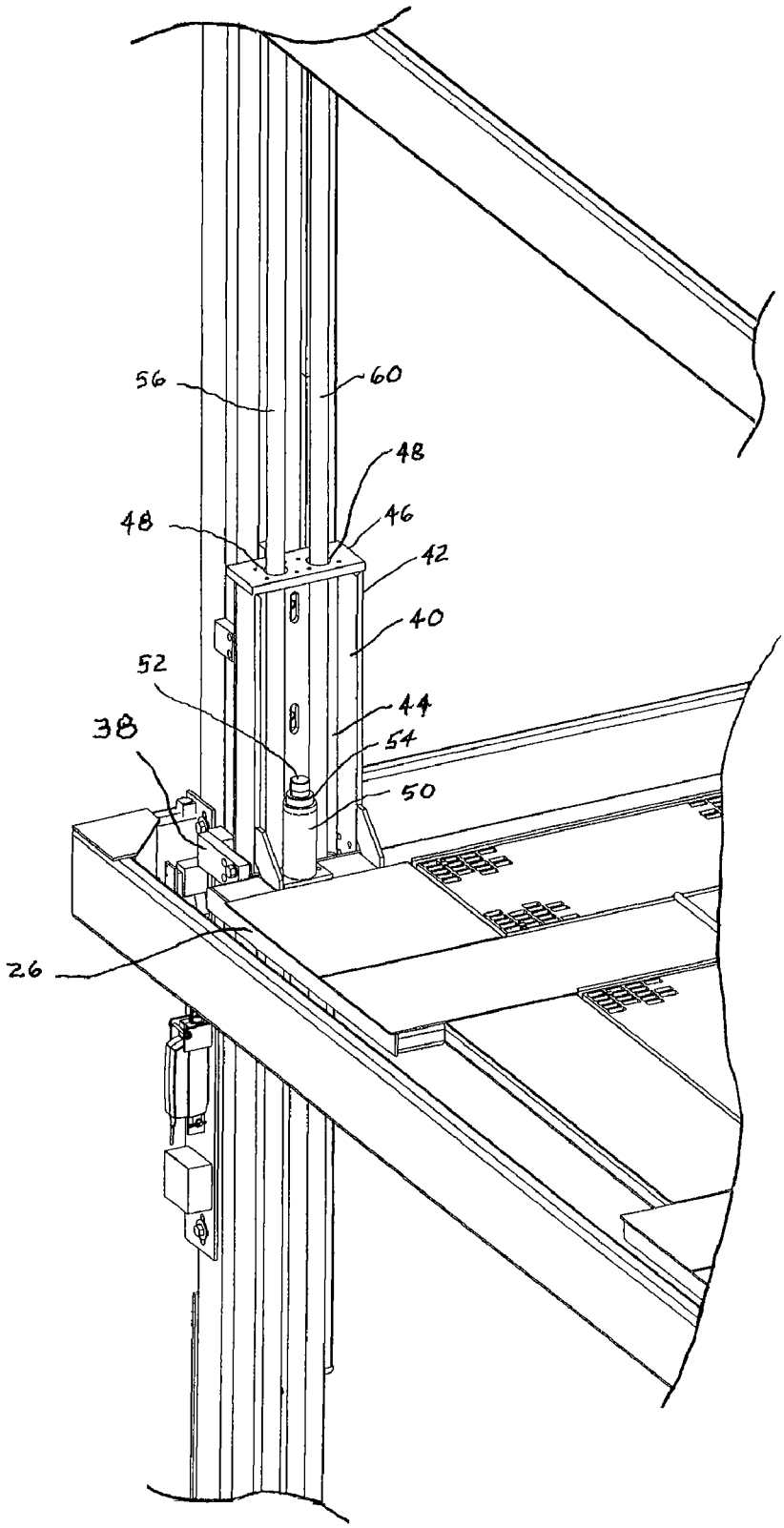
FIG. 6 is an enlarged perspective view of a side portion of the vehicle lift of FIG. 5.
Figure 7:
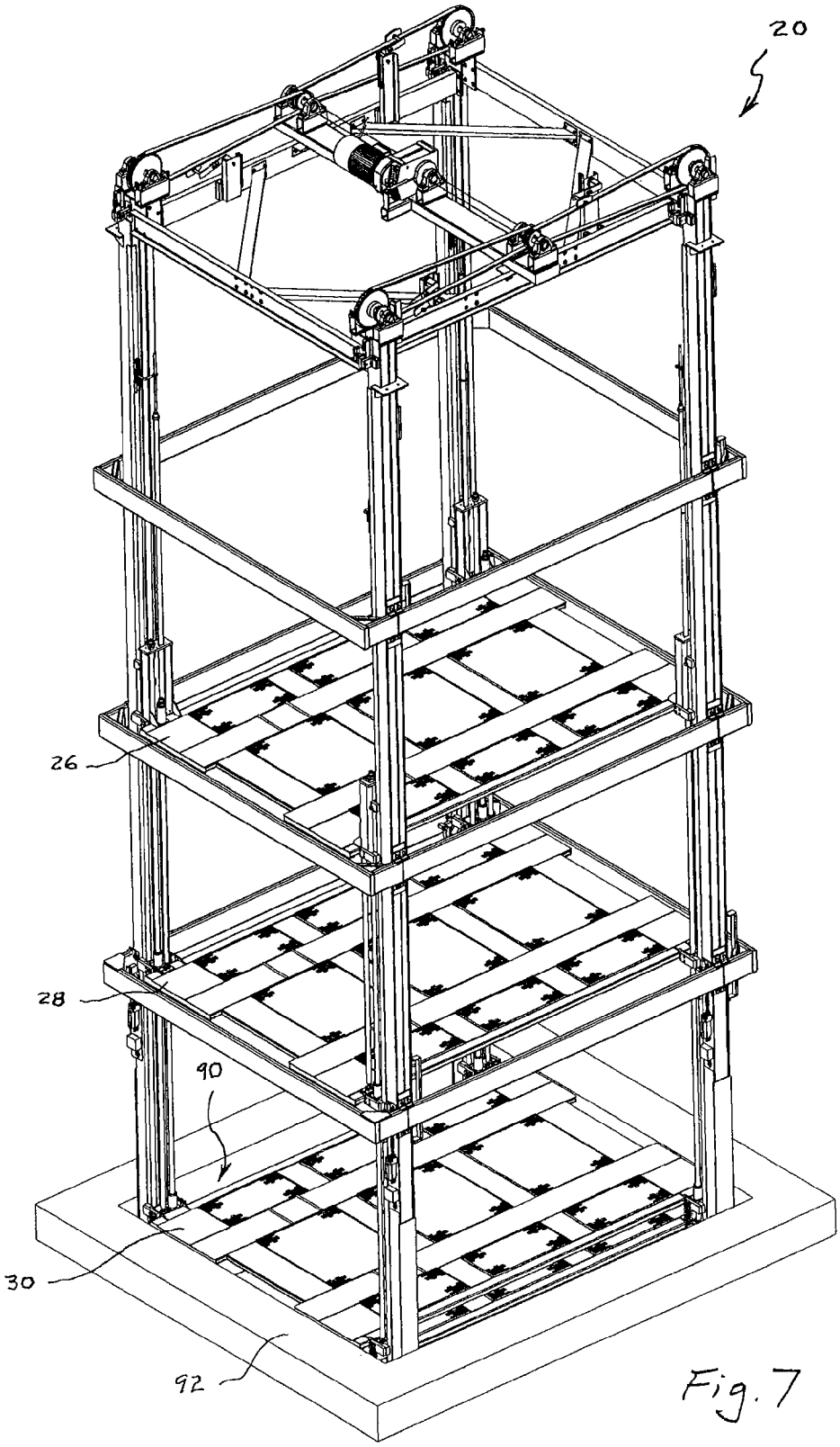
FIG. 7 is a perspective view of the vehicle lift of FIG. 1 in a second raised position.
Figure 8:
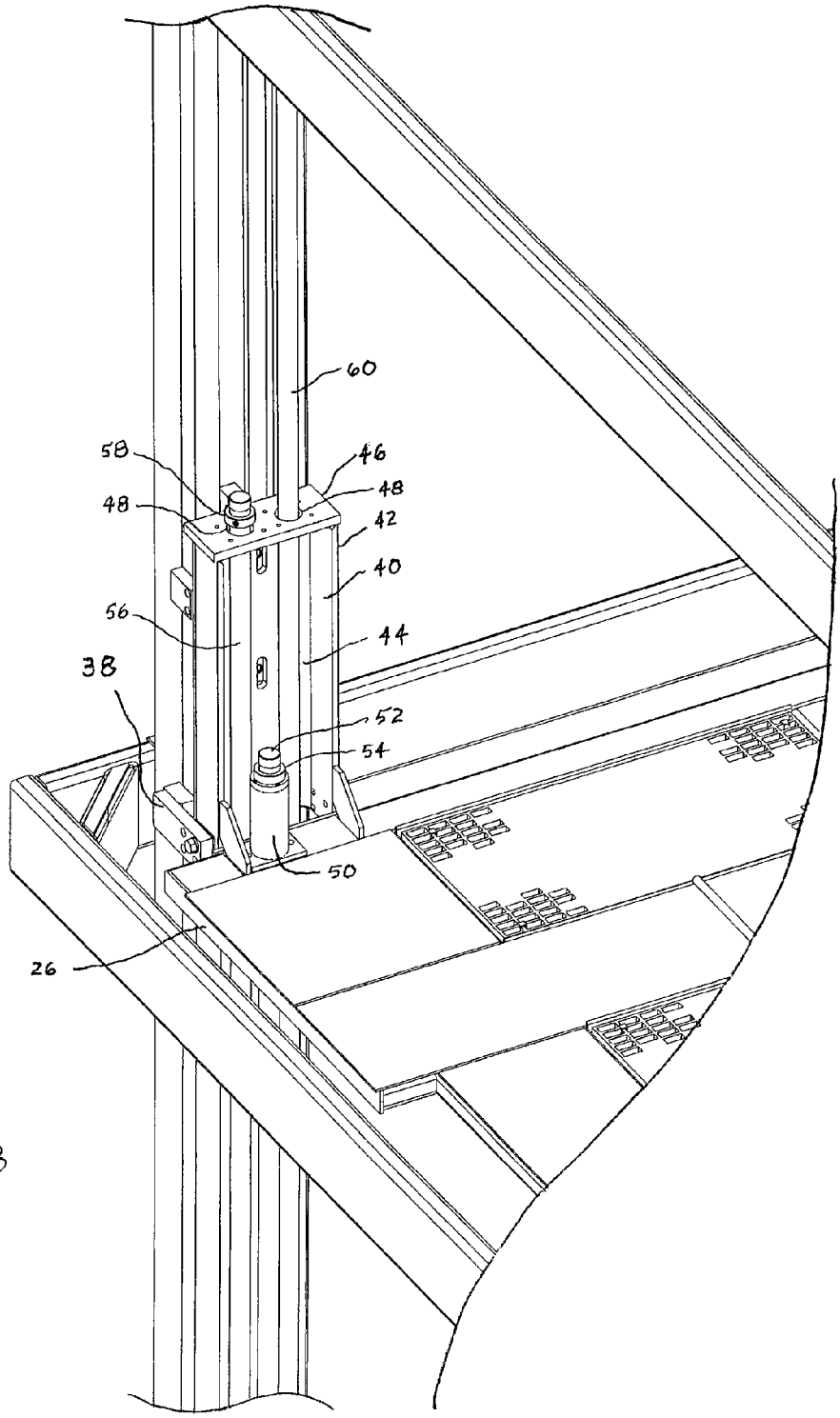
FIG. 8 is an enlarged perspective view of a side portion of the vehicle lift of FIG. 7.
Figure 9:
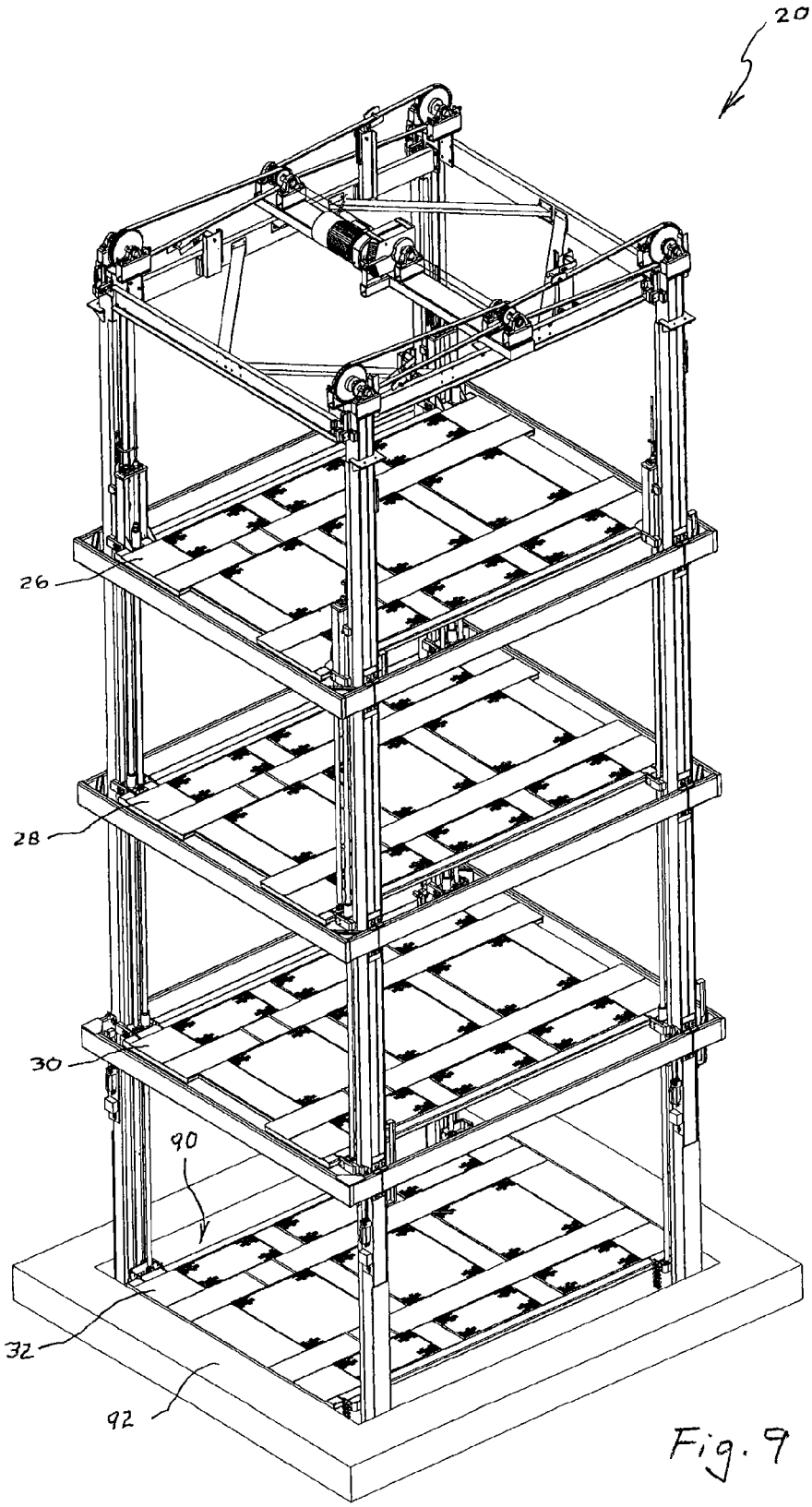
FIG. 9 is a perspective view of the vehicle lift of FIG. 1 in a fully raised position.
Figure 10:
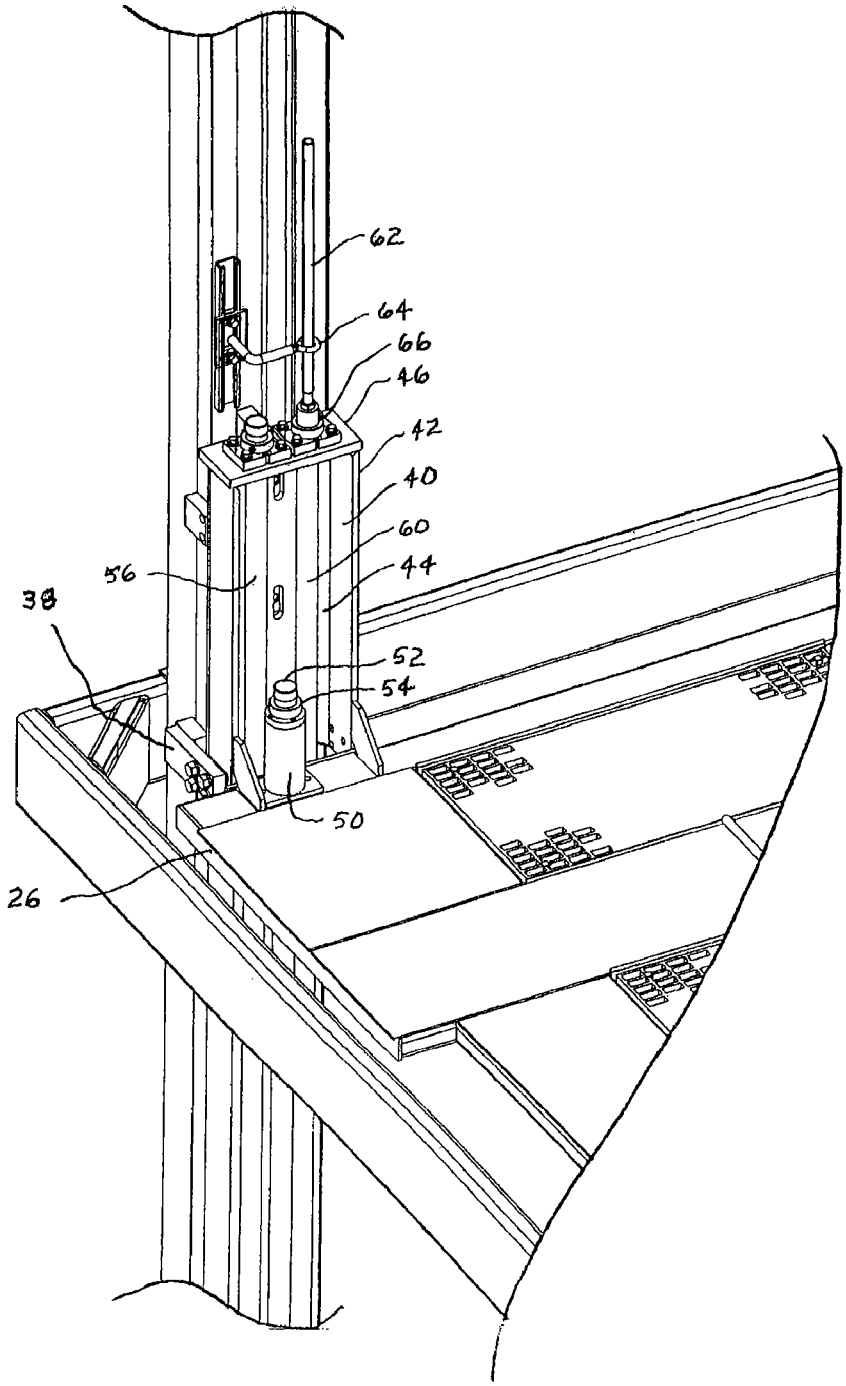
FIG. 10 is an enlarged perspective view of a side portion of the vehicle lift of FIG. 9.

After the vehicle is properly positioned on the first platform 26, the lift mechanism is actuated to thereby lift the first platform 26 upward. As the first platform 26 is moving upward, the lift tube 50 on the first platform 26 will engage the cap 54 on the short lift rod 52 (FIG. 6). After this engagement, the first platform 26 continues to move upward a short distance, thereby lifting the second platform 28 via the short lift rods 52. This additional movement continues until the upper surface of the second platform 28 is aligned with the ground surface 92, at which time the lift mechanism is deactivated. In this first raised position (shown in FIG. 5), a second vehicle can be positioned on the second platform 28.

After the second vehicle is positioned on the second platform 28, the lift mechanism is activated to further lift the first platform 26 and second platform 28. During this vertical movement, the lift housing 40 will engage the cap 58 of the medium lift rod 56 (FIG. 8), resulting in lifting of the third platform 30. Vertical movement is continued until the upper surface of the third platform 30 is aligned with the ground surface 92. At this second raised position (shown in FIG. 7), the lift mechanism is deactivated, and a third vehicle can be positioned on the third platform 30.

After the third vehicle is properly positioned on the third platform 30, the lift mechanism is activated to further lift the first, second, and third platforms 30. During this operation, the lift housing 40 will engage the cap 66 on the long lift rod 60 (FIG. 10), thereby resulting in lifting of the fourth platform 32 from the bottom of the pit 90. During this lifting of the long lift rod 60, the extended portion 62 of the long lift rod 60 will slide through the alignment member 64, and shown in FIG. 10. Vertical movement of the fourth platform 32 will continue until the upper surface of the fourth platform 32 is aligned with the ground surface 92 (FIG. 11). At the third raised position (shown in FIG. 9), a fourth vehicle can be positioned on the fourth platform 32.

The invention claimed is:

1. A vehicle lift comprising:

a support structure including four substantially vertical columns for guiding substantially linear vertical movement;

a first platform mounted between the vertical columns for substantially linear vertical movement between a lowered position and a raised position;

a second platform mounted between the vertical columns below the first platform and coupled to the first platform by a short collapsible lift member such that upward movement of the first platform above a first raised position causes upward substantially linear vertical movement of the second platform; and a third platform mounted between the vertical columns below the second platform and coupled to the first platform by a long collapsible lift member such that upward movement of the first platform above a second raised position causes upward substantially linear vertical movement of the third platform, wherein during a portion of the first platform's travel from the lowered position toward the first raised position, the first platform causes substantially no movement of the second platform.

2. The vehicle lift of claim 1, further comprising a lift mechanism coupled to the first platform.

3. The vehicle lift of claim 1, wherein the short collapsible lift member comprises a lift rod.

4. The vehicle lift of claim 1, wherein the long collapsible lift member comprises a lift rod secured at one end to the third platform and secured at an opposing end to the first platform.

5. The vehicle lift of claim 1, further comprising a fourth platform below the third platform and coupled to the first platform by a longer collapsible lift member such that upward movement of the first platform above a third raised position causes upward movement of the fourth platform.

6. The vehicle lift of claim 1, wherein at least one of the platforms is positioned within a pit when the first platform is in the lowered position.

7. The vehicle lift of claim 1, wherein all of the platforms are positioned within a pit when the first platform is in the lowered position.

8. The vehicle lift of claim 1, wherein the first platform includes four guide members, each engaging one vertical column to facilitate vertical movement within the support structure.

9. The vehicle lift of claim 1, wherein the short collapsible lift member includes a rigid first lift rod defining a first end coupled to the second platform and a second end movable relative to the first platform, and wherein the first platform engages the first lift rod to move the second platform.

10. The vehicle lift of claim 9, wherein the long collapsible lift member includes a rigid second lift rod defining a first end coupled to the third platform and a second end movable relative to the first platform, wherein the first platform engages the second lift rod to move the third platform, and wherein the second lift rod is longer than the first lift rod.

11. The vehicle lift of claim 9, wherein a short collapsible lift member is positioned substantially adjacent each vertical column.

12. A vehicle lift comprising:

a support structure including four substantially vertical columns for guiding substantially linear vertical movement;

a first platform mounted between the vertical columns for substantially linear vertical movement between a lowered position and a raised position;

a second platform mounted between the vertical columns below the first platform and coupled to the first platform by a short collapsible lift member such that upward movement of the first platform above a first raised position causes substantially linear upward movement of the second platform, wherein the first platform is adjacent to the second platform when the first platform is in the lowered position, and wherein the first platform is spaced from the second platform when the first platform is in the raised position; and a pit positioned below the first and second platforms, wherein the second platform is at least partially in the pit when the first platform is in the lowered position, wherein during a portion of the first platform's travel from the lowered position toward the first raised position, the first platform causes substantially no movement of the second platform.

13. The vehicle lift of claim 12, wherein the pit is recessed into a ground surface, and wherein an upper surface of the first platform is substantially flush with the ground surface when in the lowered position.

14. The vehicle lift of claim 13, wherein an upper surface of the second platform is lower than the ground surface when the first platform is in the lowered position.

15. The vehicle lift of claim 12, wherein an upper surface of the second platform is substantially flush with the ground surface when the first platform is in the raised position.

16. The vehicle lift of claim 12, wherein the first platform includes four guide members, each engaging one vertical column to facilitate vertical movement within the support structure.

17. The vehicle lift of claim 12, wherein the short collapsible lift member includes a rigid lift rod defining a first end coupled to the second platform and a second end movable relative to the first platform, and wherein the first platform engages the lift rod to move the second platform.

18. The vehicle lift of claim 12, wherein a short collapsible lift member is positioned substantially adjacent each vertical column.

19. A vehicle lift comprising:

a first platform mounted for movement between a lowered position and a raised position;

a second platform below the first platform and coupled to the first platform by a rigid short lift rod, wherein the first platform engages the short lift rod such that upward movement of the first platform above a first raised position causes upward movement of the second platform; and a third platform below the second platform and coupled to the first platform by a long lift rod, wherein the first platform engages the second lift rod such that upward movement of the first platform above a second raised position causes upward movement of the third platform, wherein the long lift rod is longer than the short lift rod, and wherein during a portion of the first platform's travel from the lowered position toward the first raised position, the first platform causes substantially no movement of the second platform;

a support structure including four substantially vertical columns for guiding substantially linear vertical movement of the first, second and third platforms.

20. The vehicle lift of claim 19, wherein the long lift rod is not coupled directly to the second platform such that movement of the second platform does not influence movement of the third platform.

* * * * *